US005212964A

United States Patent [19]

Utter et al.

[11] Patent Number: 5,212,964

[45] Date of Patent: May 25, 1993

[54] SCROLL APPARATUS WITH ENHANCED LUBRICANT FLOW

[75] Inventors: Robert E. Utter, Onalaska; Daniel R. Crum; Peter A. Kotlarek, both of La Crosse, all of Wis.

[73] Assignee: American Standard Inc., New York, N.Y.

[21] Appl. No.: 958,436

[22] Filed: Oct. 7, 1992

Related U.S. Application Data

[63] Continuation of Ser. No. 605,599, Oct. 29, 1992, abandoned.

[51] Int. Cl.[5] ..... F04C 18/04; F04C 29/02

[52] U.S. Cl. ..... 62/498; 418/55.6; 418/99

[58] Field of Search ..... 418/55.6, 88, 96, 98, 418/99, 188; 62/498

[56] References Cited

U.S. PATENT DOCUMENTS

| | | | |
|---|---|---|---|
| 4,568,256 | 2/1986 | Blain | 418/55.6 |
| 4,596,521 | 6/1986 | Murayama et al. | 418/55.1 |
| 4,676,075 | 6/1987 | Shiibayashi | 62/469 |
| 4,842,499 | 6/1989 | Nishida et al. | 418/55.6 |
| 4,973,232 | 11/1990 | Etou et al. | 418/55.6 |

FOREIGN PATENT DOCUMENTS

| | | | |
|---|---|---|---|
| 6380089 | 3/1989 | Japan . | |
| 2-49989 | 2/1990 | Japan | 418/55.6 |

*Primary Examiner*—John J. Vrablik

*Attorney, Agent, or Firm*—William J. Beres; William O'Driscoll; Peter D. Ferguson

[57] ABSTRACT

In a co-rotational scroll apparatus having two interleaving scroll wraps secured to end plates rotating about parallel, non-concentric axes to produce a relative orbital motion, a means for enhancing lubricant flow through the scroll wraps. One or more passages are provided in one or both of the scroll end plates, each passage disposed to discharge lubricant between the scroll end plates, discharging adjacent the outer end of the scroll wraps immediately before the point where the scroll wraps form the first compression chamber to provide lubricant to the entire scroll wrap length. Lubricant is provided to the passages by a combination of pickup tubes affixed to the scroll end plates and inlet openings in the scroll end plates. The inlet openings accept lubricant discharged from the bearings in the apparatus. The pickup tubes rotate with the scroll end plates and remove lubricant from a sump adjacent the scroll end plates.

32 Claims, 7 Drawing Sheets

FIG. 1
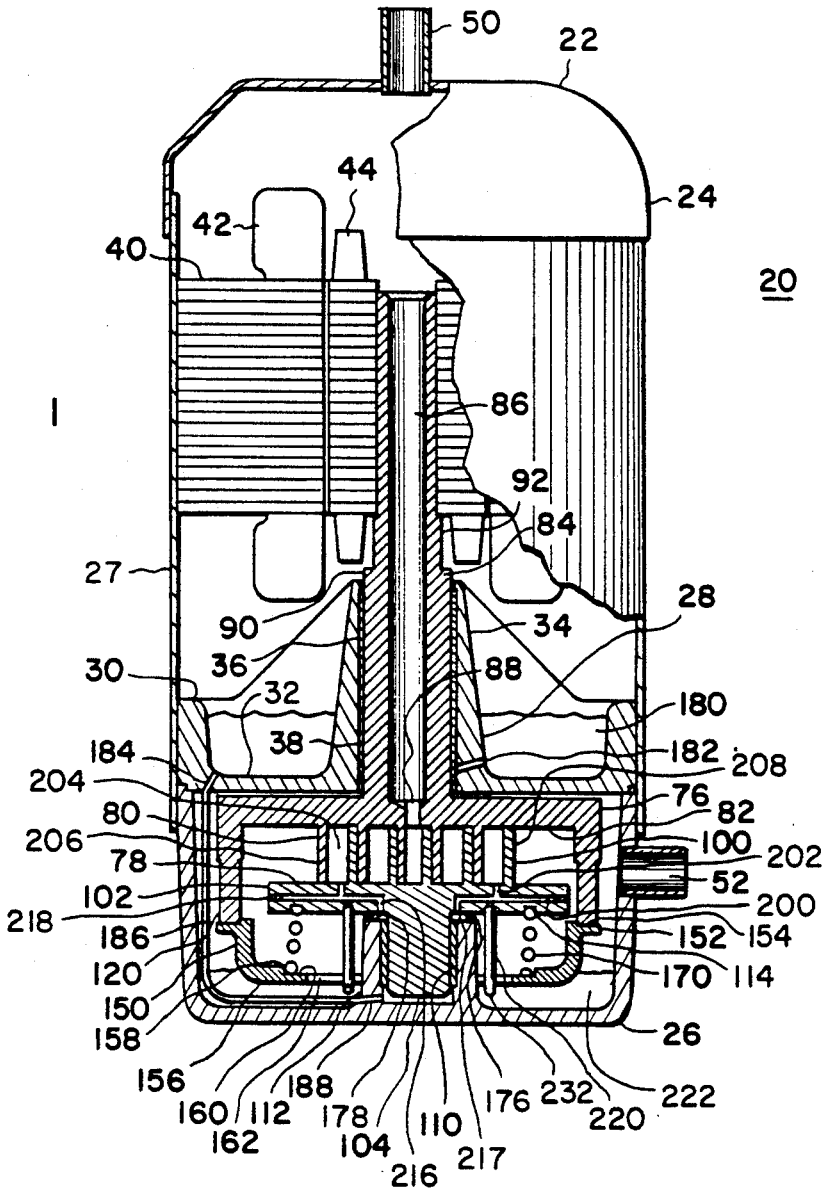
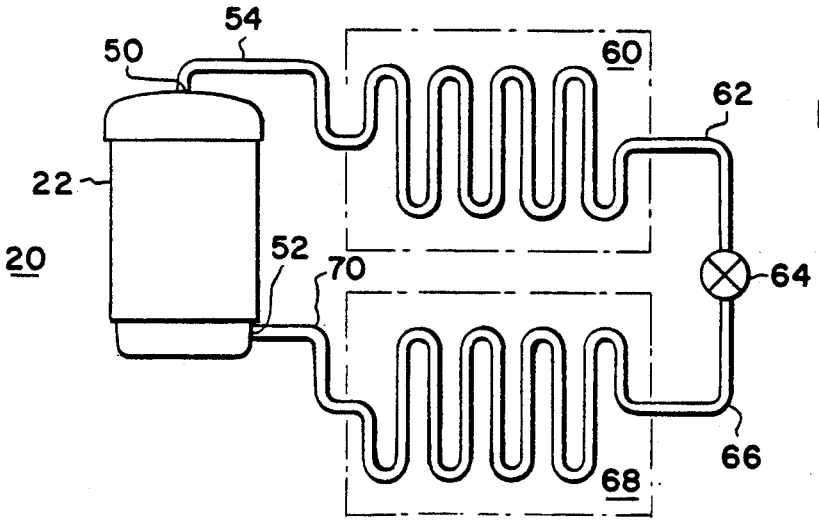
FIG. 2

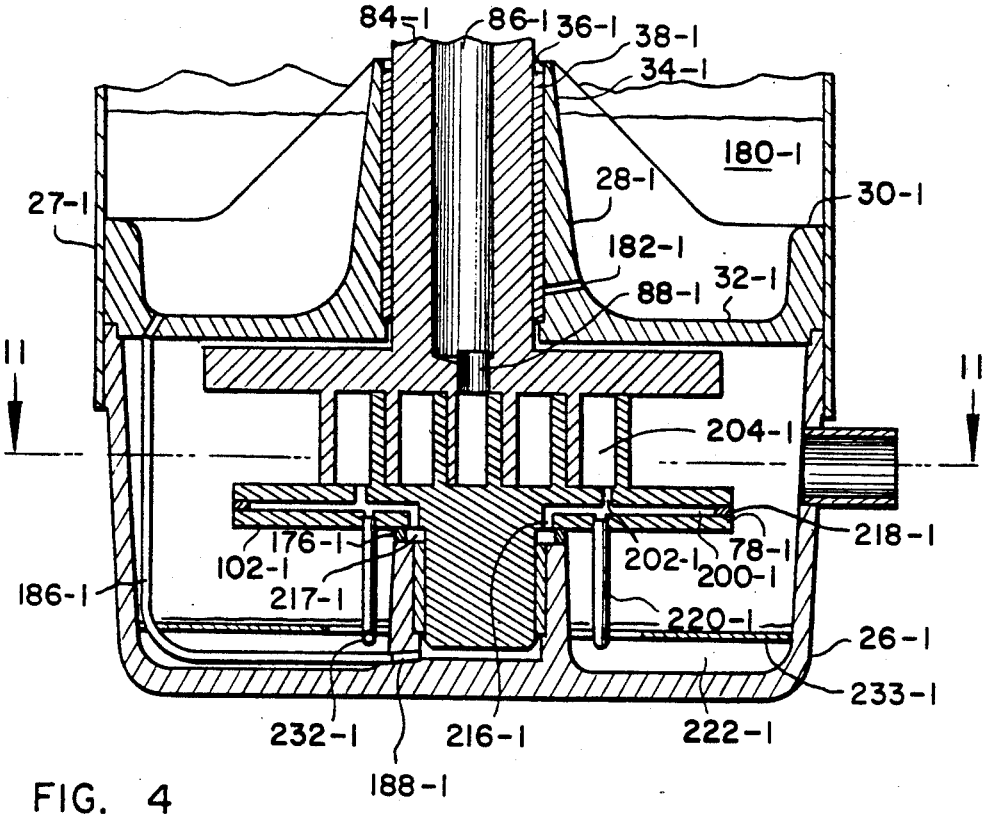
FIG. 4
FIG. 3
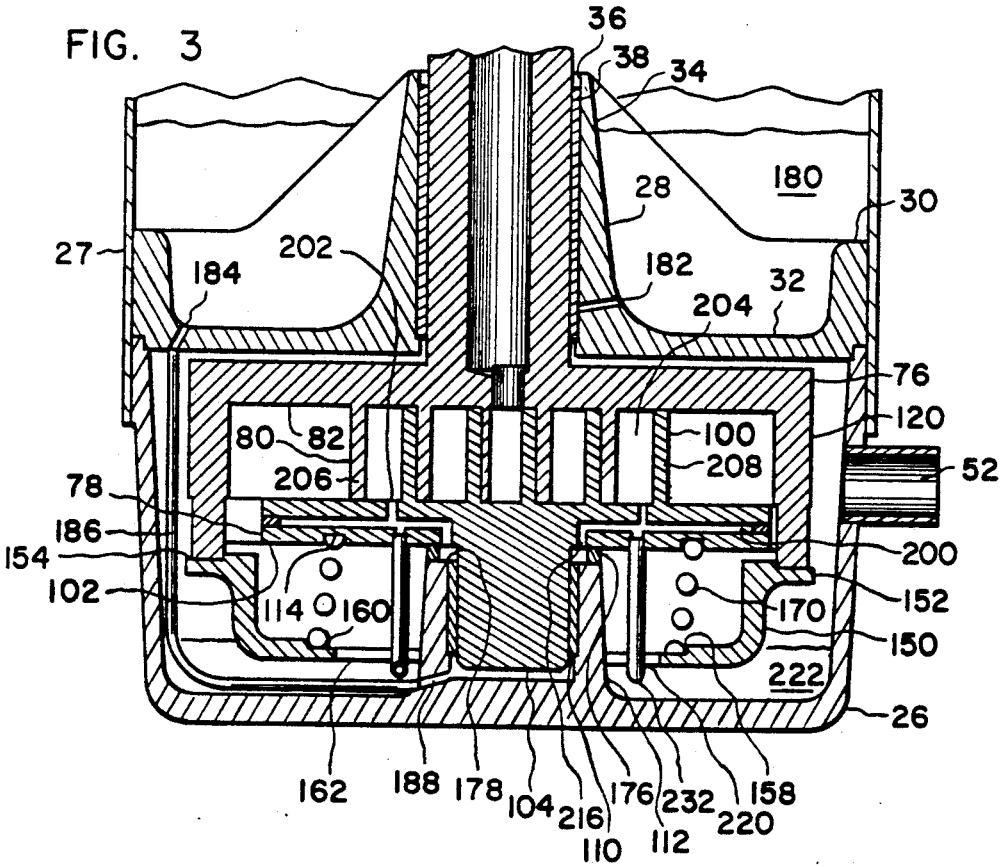

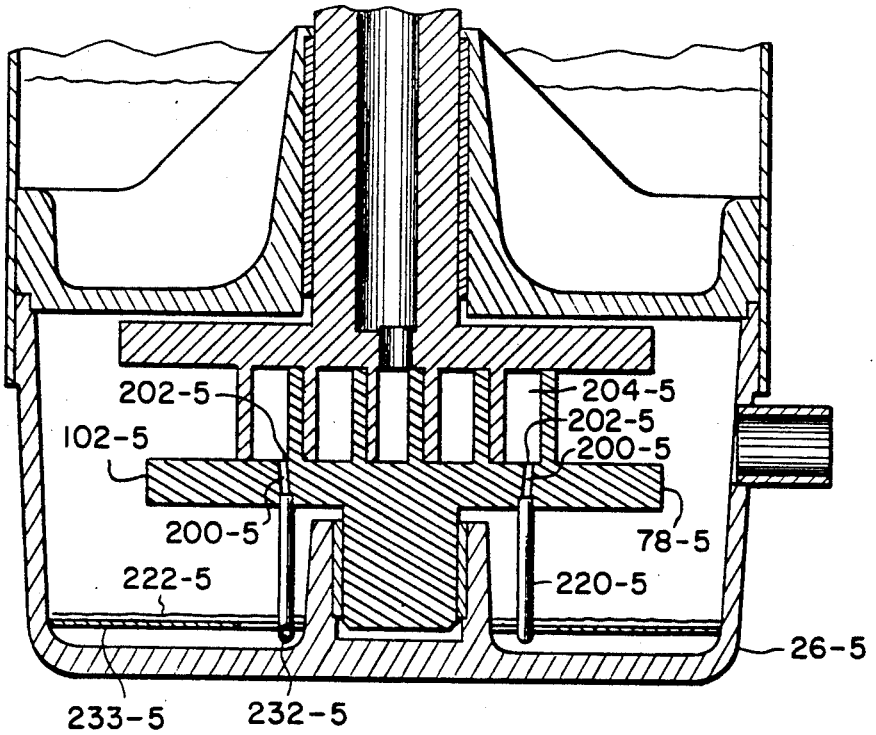
FIG. 8
FIG. 9
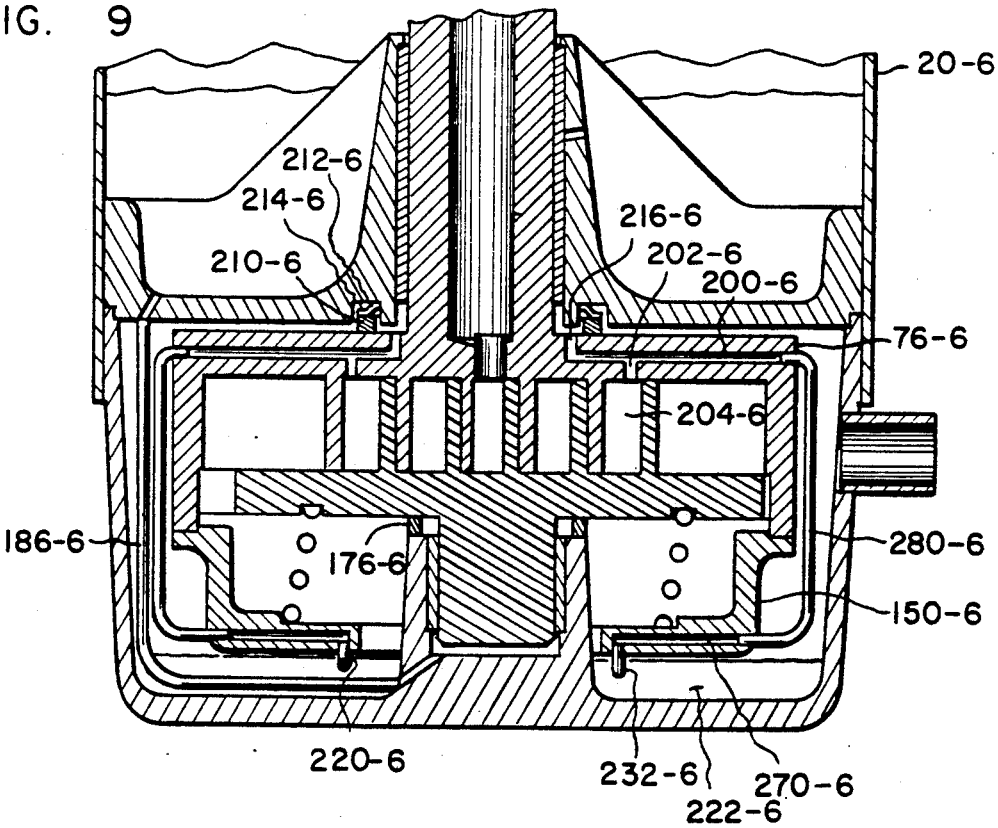

SCROLL APPARATUS WITH ENHANCED LUBRICANT FLOW

This is a continuation of application Ser. No. 07/605,599, filed Oct. 29, 1992, that application having been abandoned in due course.

DESCRIPTION

1. Technical Field

This invention generally pertains to scroll apparatus and specifically to co-rotating scroll-type fluid apparatus having means for enhancing the flow of lubricant through the scroll wraps.

2. Background Art

Scroll apparatus for fluid compression or expansion are typically comprised of two upstanding interfitting involute spirodal wraps which are generated about respective axes. Each respective involute wrap is mounted upon an end plate and has a tip disposed in contact or near-contact with the end plate of the other respective scroll wrap. Each scroll wrap further has flank surfaces which adjoin in moving line contact, or near contact, the flank surfaces of the other respective scroll wrap to form a plurality of moving chambers. Depending upon the relative orbital motion of the scroll wraps, the chambers move from the radial exterior end of the scroll wraps to the radially interior ends of the scroll wraps for fluid compression, or from the radially interior end of the respective scroll wraps for fluid expansion. The scroll wraps, to accomplish the formation of the chambers, are put in relative orbital motion by a drive mechanism which constrains the scrolls to non-rotational relative motion. The general principles of scroll wrap generation and operation are discussed in numerous patents, such as U.S. Pat. No. 801.182.

Numerous attempts have been made to develop co-rotational scroll apparatus. Such apparatus provides for concurrent rotary motion of both scroll wraps on parallel. offset axis to generate the requisite orbital motion between the respective scroll wrap elements. However, most commercially successful scroll apparatus to date have been of the fixed scroll-orbiting scroll type due to various difficulties in achieving success with co-rotating scroll apparatus.

Typically, a number of rotary bearings are required in a co-rotational scroll apparatus, which decreases the reliability and efficiency of the machine. Furthermore, the typical co-rotating scroll apparatus have required a thrust bearing acting upon each of the scroll end plates to prevent axial scroll separation, thus substantially increasing the power requirements of the machine as well as substantially reducing the reliability of the machine.

In addition to the energy consumed by the additional bearing surfaces typically found, other energy losses can occur. As the scrolls rotate, fluid around and in the vicinity of the scrolls is "fanned" by the scroll members. After the scrolls have been rotating for a period of time, the fluid adjacent the scrolls develops a swirling or centrifugal flow field around the periphery of the scrolls due to the motion of the scroll members. This presents a substantial difficulty when the scroll members are contained in a shell or enclosure, with respect to obtaining and controlling adequate lubricant flow through the scroll wraps of a co-rotational scroll apparatus.

In many applications such as refrigeration and air conditioning, the scroll apparatus is employed as a gas compressor in a closed circuit system. Lubrication of the compressor in such systems is typically accomplished by providing a lubricant which is miscible in the gas to be compressed, and circulating all or a portion of this lubricant in the closed system. The effect of the centrifugal flow field is to precipitate this miscible lubricant out of the gas, leaving effectively no lubricant available to flow through the scroll wraps of the scroll apparatus and filling the container in which the scrolls rotate with lubricant. This lubricant accumulating in the container also tends to be swirled by the scrolls, requiring additional energy input to the scrolls.

In certain co-rotational scroll apparatus, lubricant is also provided to the bearings supporting the scroll elements. This lubricant also contributes to the lubricant accumulation in the container as it flows from the bearings after having lubricated them.

Therefore it is an object of the present invention to provide a co-rotational scroll apparatus which is efficient in operation.

It is another object of the present invention to provide such a scroll apparatus as will be suitable for use in closed circuit systems such as refrigeration systems.

It is yet another object of the present invention to provide a co-rotational scroll apparatus as will maintain a controlled, effective and adequate flow of lubricant therethrough.

It is yet another object of the present invention to provide such a scroll apparatus as will be simple and inexpensive and suitable for mass production.

These and other objects of the present invention will be apparent from the attached drawings and the description of the preferred embodiment that follows hereinbelow.

SUMMARY OF THE INVENTION

The subject invention is a co-rotational scroll apparatus having two concurrently rotating scroll elements acting as a compressor, each having a scroll wrap thereon for interleaving engagement with the other respective scroll wrap. The scroll elements operate in a container or shell which is provided with an inlet for fluid and are oriented so that the axes of the scroll elements are generally vertical. One or more of the scroll elements are provided with passages which communicate through the scroll element to discharge lubricant between the scroll end plates, discharging through outlets or openings adjacent the outer end of the scroll wraps adjacent the point where the scroll wraps form the first compression chamber to provide lubricant to the entire scroll wrap length. The discharge outlets can be disposed in the scroll end plate at any location adjacent the outer ends of the scroll wraps which permit lubricant flow into the first compression chamber as it is formed.

Lubricant is provided to the passages by pickup tubes generally extending from the scroll element or elements having the passages into the sump formed in the bottom portion of the container. The pickup tubes rotate with the scroll end plates with end openings oriented in the direction of travel and generate a pressure differential due to the velocity of the pickup tubes within the lubricant sump to remove lubricant from the sump and force the lubricant into the passages. An additional force contributing to the lubricant pickup is centrifugal force, the result of disposing the pickup tubes radially inward of the discharge outlet of the passage.

In co-rotational scroll apparatus having lubricated bearings, additional lubricant may be provided to the discharge openings from inlet openings disposed adjacent the bearings. A seal is provided between the scroll member and the selected bearing to form a collection chamber for lubricant discharged from the bearing. The inlet openings are located radially inward of the discharge openings and centrifugal force developed by the rotation of the scroll member moves the collected lubricant from the collection chamber to the discharge opening.

BRIEF DESCRIPTION OF THE DRAWINGS

FIG. 1 shows a cross-sectional view of a co-rotational scroll apparatus embodying the subject invention.

FIG. 2 shows in schematic a closed circuit system such as a refrigeration or air conditioning system in which the subject invention could suitably be employed.

FIG. 3 shows an enlarged partial cross-sectional view of the scroll apparatus of FIG. 1.

FIG. 4 shows an enlarged partial cross-sectional view of a first alternative embodiment of the scroll apparatus embodying the subject invention.

FIG. 8 shows an enlarged partial cross-sectional view of a fifth alternative embodiment of the subject invention.

FIG. 9 shows an enlarged partial cross-sectional view of a sixth alternative embodiment of the scroll apparatus.

DESCRIPTION OF THE PREFERRED EMBODIMENT

Figure 5:
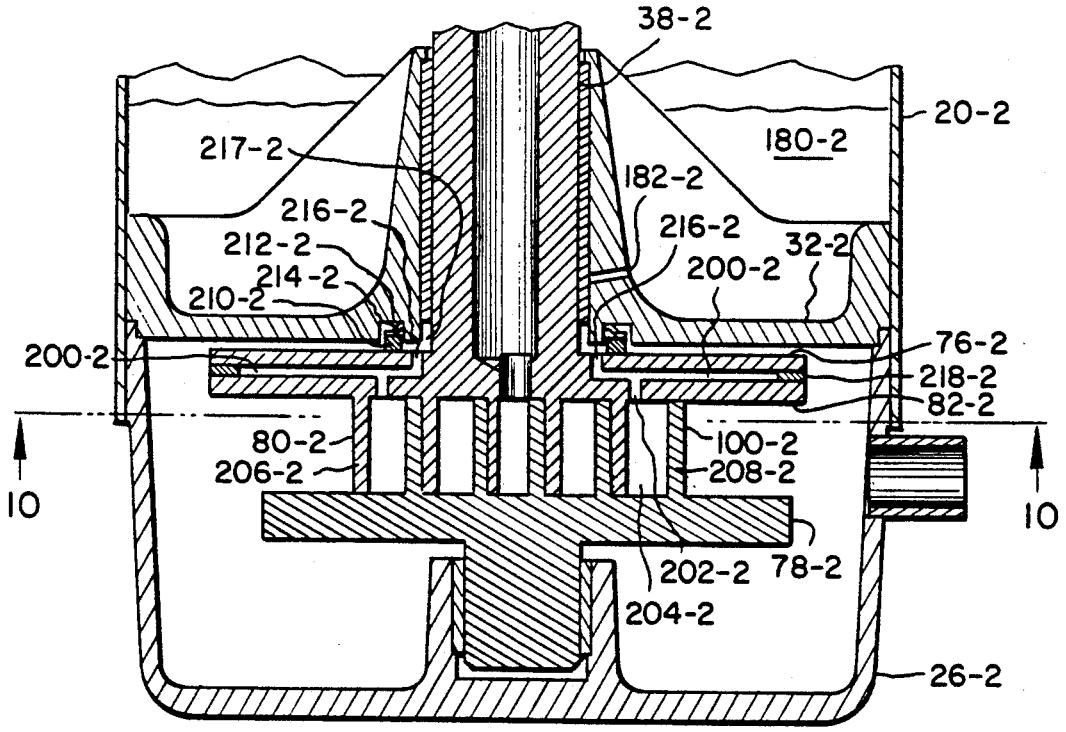
FIG. 5 shows an enlarged partial cross-sectional view of a second alternative embodiment of the subject invention.

A scroll type fluid apparatus generally shown in FIG. 1 as a scroll compressor assembly is referred to by reference numeral 20. As the preferred embodiment of the subject invention is a hermetic scroll compressor assembly, the scroll compressor assembly is shown and described as a hermetic scroll compressor assembly. The scroll compressor assembly 20 is interchangeably referred to as a scroll apparatus or as a compressor assembly 20. It will be readily apparent to those skilled in the art that the features of the subject invention may readily be employed in scroll apparatus which are used as fluid pumps or expanders, and in scroll apparatus which are not of the hermetic type.

In the preferred embodiment, the compressor assembly 20 includes a hermetic shell 22 having an upper portion 24, a lower portion 26, a central exterior shell 27 extending between the upper portion 24 and lower portion 26, and an intermediate, central frame portion 28 affixed within the central exterior shell 27. The exterior shell 27 is a generally cylindrical body, while the central frame portion 28 is defined by a generally cylindrical or annular exterior portion 30 and a central portion 32 disposed across one end thereof. The annular exterior portion 30 of the central frame portion 28 is sized to sealingly fit within the exterior shell 27 so that it may be mated thereto by a press fit, by welding, or by other suitable means.

Integral with the central frame portion 28 is a generally cylindrical upper bearing housing 34, which is substantially coaxial with the axis of the annular exterior portion 30. A drive shaft aperture 36 extends axially through the center of the upper bearing housing 34, and an upper main bearing 38 is disposed radially within the drive shaft receiving aperture 36. Preferably, the upper main bearing 38 is a rotation bearing made, for example, of sintered bronze or similar material. The upper main bearing 38 may also be of the roller or ball bearing type.

A motor 40 is disposed within the upper portion 24 and shell portion 27 of the hermetic shell 22. The motor 40 is preferably a single phase or three phase electric motor comprised of a stator 42 which is circumferentially disposed about a rotor 44, with an annular space therebetween permitting free rotation of the rotor 44 within the stator 42 as well as the flow of lubricant or refrigerant fluid. The stator 42 may be affixed within the exterior shell 27 by press fit therebetween, by a plurality of bolts or screws (not shown), by weldments between appropriate mounting surfaces on the stator 42 and the exterior shell 27 (not shown), or by other means. It will be readily apparent to those skilled in the art that alternative types of motors 40 and means of mounting the motor 40, and alternative types of drive means, would be equally suitable for application in the subject invention.

A discharge aperture 50 is shown in the upper shell portion 24 for discharging high pressure fluid from the scroll apparatus 20, and a shell suction aperture 52 is shown disposed in the lower shell portion 26 for receiving low pressure fluid into the scroll apparatus 20. This permits connection of the scroll apparatus 20 to a suitable fluid system. Preferably, the scroll compressor apparatus 20 would be connected to a refrigeration or air conditioning system. Such a system is shown generally in schematic representation in FIG. 2. The representative system includes a discharge line 54 connected between the shell discharge aperture 50 and a condenser 60 for expelling heat from the refrigeration system and condensing the refrigerant. A line 62 connects the condenser to an expansion device 64. The expansion device may be a thermally actuated or an electrically actuated valve controlled by a suitable controller (not shown), or may be one or more capillary tubes. Another line 66 connects the expansion device 64 to an evaporator 68 for transferring expanded refrigerant from the expansion device 64 to the evaporator 68 for acceptance of heat. Finally, a refrigeration system suction line 70 transfers the evaporated refrigerant from the evaporator 68 to the compressor assembly 20, wherein the refrigerant is compressed and returned to the refrigeration system.

It is believed that the general principles of refrigeration systems capable of using such a compressor system 20 are well understood in the art, and that detailed explanation of the devices and mechanisms suitable for constructing such a refrigeration system need not be discussed in detail herein. It is believed that it will also be apparent to those skilled in the art that such a refrigeration or air conditioning system may include multiple units of the compressor assembly 20 in parallel or series connections, as well as multiple condensers or evaporators and other components, hence such embodiments of refrigeration systems need not be discussed here in detail.

Having described the general construction of the compressor assembly 20, the features of the present invention are now described in more detail. Referring again to FIG. 1 and more particularly to FIG. 3, a scroll apparatus having a drive scroll member, arbitrarily designated the first scroll member 76, and an idler scroll member, arbitrarily designated the second scroll member 78, is disclosed. The first scroll member 76 includes an upstanding first involute scroll wrap 80 which is integral with a generally planar drive scroll end plate 82. The drive scroll end plate 82 includes a generally centrally disposed first scroll member drive shaft 84 extending oppositely from the upstanding involute scroll wrap 80. A discharge gallery 86 is defined by a bore extending through the axis of the drive shaft 84. The discharge gallery 86 is in flow communication with a discharge aperture 88 defined by a generally central bore through the drive scroll end plate 82. The drive shaft 84 includes a first, relatively larger diameter bearing portion 90 extending axially through the upper main bearing 38 for a free rotational fit therein, and a second relatively smaller diameter rotor portion 92 which extends axially through the rotor 44 and is affixed thereto. The rotor 44 may be affixed to the rotor portion 92 by such means as a power transmitting key in juxtaposed keyways, a press fit therebetween, or other suitable means.

The second or idler scroll member 78 includes a second, idler scroll wrap 100 which is disposed in interfitting and interleaving engagement with the first scroll wrap 80. The second scroll member 78 also includes a substantially planar second or idler end plate 102. The idler scroll wrap 100 is generally an upstanding involute extending from the idler end plate 102. A second scroll shaft or idler shaft stub 104 extends from the idler end plate 102 oppositely from the idler scroll wrap portion 100. The designation of the idler scroll member 78 as the second scroll member and the drive scroll member 76 as the first scroll member is arbitrary and may be made interchangeably without affecting the character of the invention An annular bearing 110, which may be a sleeve bearing made of sintered bronze material, for example, or may be of the roller or ball type, is disposed within an annular wall defining a second shaft or idler bearing housing 112. The second shaft or lower bearing housing 112 is integral with the lower hermetic shell portion 26 for rotationally supporting the second scroll member 78.

The first scroll end plate 82 also includes two extension members 120 extending from the first scroll end plate 82 parallel the drive scroll wrap 80. The extension members 120 are disposed at radially opposed positions near the outer edge of the first scroll end plate 82 and are of greater length than the height of the involute scroll wraps 80 and 100, respectively, plus the thickness of the second scroll end plate 102. The extension members 120 are affixed to an annular first scroll member compression plate 150. The compression plate 150 is generally cup shaped, having an annular generally planar circumferential portion 152 about the radial outward end thereof. The radially outward portion includes a recess 154 for each extension member 120. The extension member 120 may be affixed in the recess 154 by such means as threaded fastener, welding or press fit. A depressed planar central portion 156 is parallel to and downwardly spaced a distance from the outer end portion 152 of the compression plate 150. This central portion 156 includes a second, slightly more downwardly spaced area describing an annular retaining shoulder 158 and a biasing surface 160. A central aperture 162 is described by a bore through the axial center of the depressed portion 156. The central aperture 162 is of substantially greater diameter than the lower bearing housing 112 so that there is sufficient clearance between the compression plate 150 and the lower bearing housing 112 to permit the compression plate 150 to rotate freely about the lower bearing housing 112.

A compression and drive spring 170 is disposed between the biasing surface 160 and the second scroll end plate 102. The compression spring 170 serves as a biasing means to force the respective scroll end plates 82 and 102 toward each other by exerting a force upon the second scroll end plate 102 and an opposite force upon the first scroll end plate 82 through the compression plate 150 and extension members 120. In the preferred embodiment, the spring 170 is retained within an annular channel 114 formed in the second scroll end plate 102. This permits the spring 170 also to act as a torque transmitting element. In this embodiment, the extension members, the compression plate 150 and the spring 170 together comprise a drive means for causing concurrent rotation of the first scroll member 76 and second scroll member 78.

An annular thrust bearing 176 is disposed on an upper shoulder 178 of the lower bearing housing 112 for accepting the weight of the first and second scroll members 76 and 78 as well as the drive shaft 90 and the rotor 44. It will be appreciated by those skilled in the art that although the scroll apparatus 20 is shown having its axis generally vertically aligned, that the apparatus 20 will function equally well in nonvertical orientations. It is desirable, however, to maintain a vertical or near vertical position (for example, within 45 degrees of vertical) so that the mass of the rotor 44 and the scrolls 76 and 78 will bias the second scroll member 78 against the thrust bearing 176.

Finally, a reservoir 180 for containing lubricant is provided in the central portion 32 of the frame portion 28. The lubricant therein is provided to the upper main bearing 38 through an upper bearing lubricant bore 182 in the upper bearing housing 34. Lubricant is provided to the lower bearing 110 through a bore 184 which provides flow communication through the central frame 30 for lubricant from the reservoir 180 into a lubricant feed tube 186 and thence through a passage 188 in the lower bearing housing 112. The upper main bearing 38 and the lower bearing 110 are sized with respect to their housings 34 and 112 so that the flow of lubricant discharged into the suction pressure portion of the hermetic shell defined by the lower portion 26 and central frame 30 is controlled in quantity.

A lubricant passage 200 extends radially outward in the second scroll end plate 102. A lubricant passage outlet 202 permits fluid flow from the lubricant passage 200 to the first chamber 204 formed by the outer ends 206 and 208 of the scroll wraps 76 and 78, respectively. It will be noted that while the first chamber 204 in a compression device is a compression chamber, the first chamber 204 is in fact also a suction chamber since it is open to suction pressure during at least a portion of the rotation of the scroll apparatus, so that the term is used interchangeably herein.

Since the pressure of the lubricant in the lubricant passage 200 is at or slightly above the suction pressure, it will be appreciated that lubricant flow into the first chamber can occur only when the pressure in the first chamber is at or only slightly above the suction pressure. Therefore, the lubricant passage outlet 202 must be defined in the first scroll end plate 82 at a location adjacent the outer tips 206 or 208 of the scroll end plates 82 or 102 to permit lubricant to flow into the first compression chamber 204 when the first chamber 204 is open to the suction pressure chamber defined by the lower shell 26 and the central frame 30. It will be apparent to those skilled in the art that because of the minimal pressure difference between the lubricant flowing in the lubricant passage 200 and the pressure of the fluid accepted into the first chamber when the first chamber is open. that the lubricant passage outlet 202 must be disposed to permit lubricant flow into the first chamber 204 before there has been any substantial compression therein, as such compression could result in a pressure exceeding the pressure of the lubricant and preventing lubricant flow. The preferable disposition of locations of the lubricant passage outlet 202 is more clearly shown in FIGS. 10 and 11, discussed hereinafter.

A lubricant passage inlet 216 is provided at the radially inner end of the lubricant passage 200 for receiving lubricant from a collection chamber 217 disposed between the second scroll end plate 102 and the thrust bearing 176, which comprises a means for delivering lubricant from the bearing 110 to the lubricant passage inlet 216. Another lubricant passage inlet comprised of a lubricant pickup tube 220 having an inlet 232 is provided at a location slightly radially outward of the inlet 216. The inlet portion 232 of the lubricant pickup tube 220 extends into a sump 222 defined in the suction pressure portion of the scroll apparatus 20. Either the lubricant passage inlet 216 or the pickup tube inlet 232 may arbitrarily be referred to as a first or second inlet to the lubricant passage 200.

A plug 218 is provided in the outer radial end of the lubricant passage 200. This plug 218 is necessitated by the fact that the lubricant passage 200 as shown is drilled into the second scroll end plate 102. Alternative means of constructing the second scroll end plate 102 might render the plug 218 unnecessary, as the passage 200 would be fully contained within the second scroll end plate 102. Those skilled in the art will recognize that alternative means of forming the passage 200 or of replacing the plug 218 are available.

It will also be appreciated by those skilled in the art that while two radially opposed lubricant passages 200 are shown in the second scroll end plate 102 as disclosed, it would be possible to provide three, four or more lubricant passages 200, and such passages 200 need not be either radially opposed or equally radially or angularly spaced. Furthermore, it would also be possible to provide a single lubricant passage 200, which in some applications may be desirable for improving the dynamic balance of the scroll member in which the passage 200 is provided. Therefore, the provision of two identical means of providing the lubricant flow are shown in each embodiment and figure of the specification for descriptive purposes only.

Figure 10:
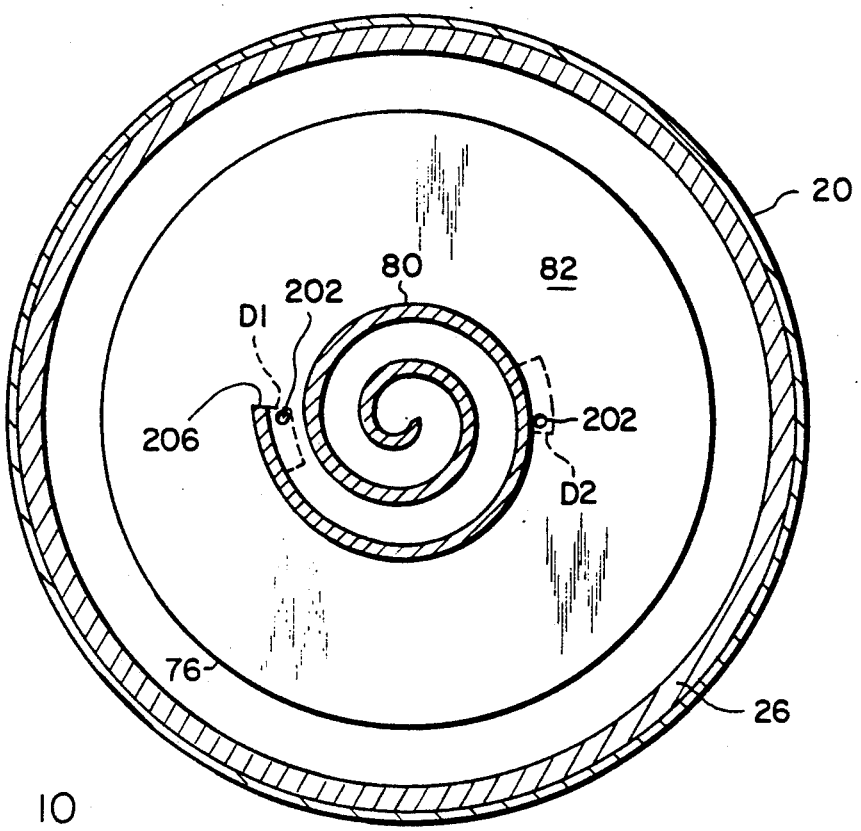
FIG. 10 shows a cross-sectional view of the drive scroll, taken along section line 10—10 of FIG. 5 with the preferred disposition of the lubricant passage outlets highlighted thereon.
Figure 11:
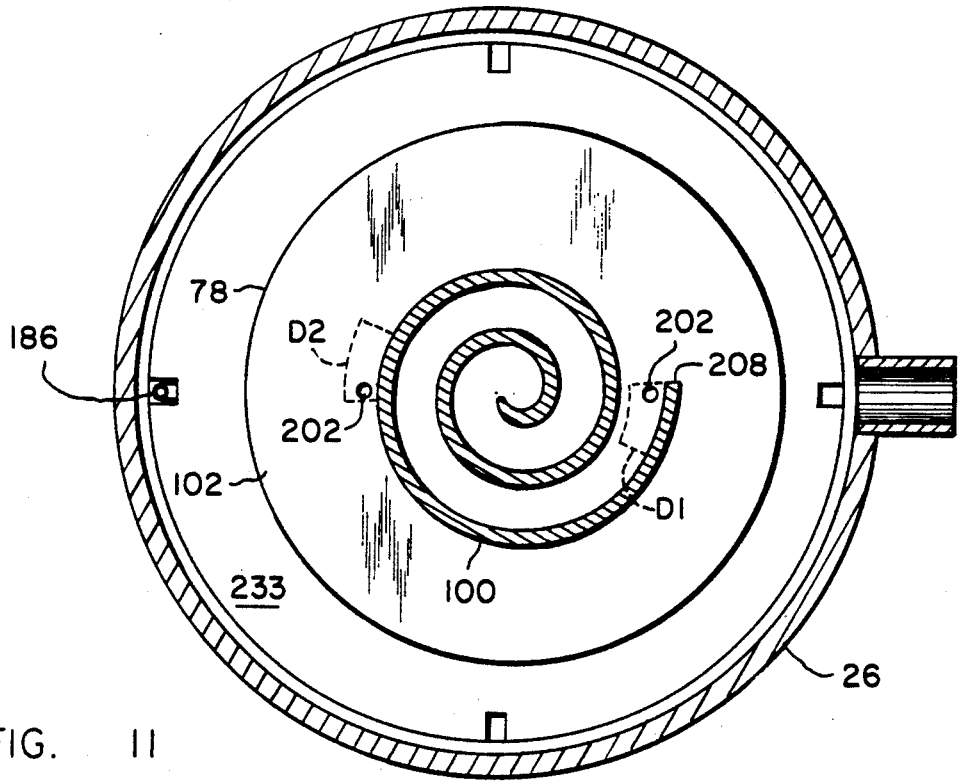
FIG. 11 shows a cross-sectional view of the idler scroll, taken along section line 11—11 of FIG. 4 with the preferred disposition of the lubricant passage outlets highlighted thereon.

FIGS. 10 and 11 contain cross-section views of the scroll members 76 and 78, taken from FIGS. 5 and 4, respectively, for convenience. In FIGS. 10 and 11, outlined areas D1 and D2 represent exemplary portions of the scroll end plate in which the lubricant passage outlets 202 may preferably be disposed. In FIG. 10, D1 represents the area adjacent the end 206 of the scroll wrap 80, while D2 represents the area adjacent the end 208 of the opposing scroll wrap 100. In FIG. 11, D1 represents the area adjacent the end 208 of the scroll wrap 100, while D2 represents the area adjacent the end 206 of the opposing scroll wrap 80. The areas Dl and D2 should be considered exemplary rather than limiting, as variations in scroll profiles and other similar factors and the desirability of using a greater or lesser number of lubricant passages 200 or outlets 202 may alter the actual disposition thereof.

It will be appreciated that the outlet 202 is preferably disposed close to the scroll wrap in each case to maximize lubricant flow prior to closure of the first chamber 204. Likewise, the outlet 202 will preferably be disposed as closely as possible to the end of the scroll wrap 80 or 100 to which the outlet 202 is disposed so as to maximize lubricant flow. As the outlet 202 is disposed at a point increasingly removed circumferentially from the scroll wrap end 206 and 208 or removed radially from the scroll wrap 80 and 100, the length of time during which the outlet 202 will be exposed to the pressurized fluid within the first chamber 204 during a portion of each compression cycle increases. This pressure could overcome the relatively low pressure in the lubricant passage 200, causing a flow reversal and undesirable flow of the pressurized fluid from the first chamber 204 into the lubricant passage 200, and it is therefore generally desirable to reduce the length of time during which the outlet 202 will be exposed to the pressurized fluid within the first chamber 204 in order to prevent the potential flow reversal.

Turning now to FIGS. 4, 5, 6, 7, and 8, several alternative embodiments of the subject invention will be described. In FIGS. 4 through 8, the scroll apparatus 20 is shown without an interconnecting drive means between the first scroll member 76 and the second scroll member 78. Those skilled in the art will recognize that FIGS. 4 through 8 are intended to teach specifically the alternatives of the subject invention, while FIGS. 1, 3 and 9 teach the application of the subject invention in the scroll apparatus 20 as described herein, and such application should be understood to be exemplary rather than limiting in nature.

Those skilled in the art will recognize that alternative means of causing concurrent rotation between the first scroll member 76 and second scroll member 78 are readily available. These include the use of flexible members affixed to the respective scroll end plates or the use of the extension members and drive keys to operate a ring or Oldham coupling between the respective scroll end plates. As there are various alternative drive means for rendering operational the co. rotational scroll apparatus 20, the drive means is omitted for the sake of clarity in these figures.

It should be noted that when the same item or feature is shown in more than one of the figures, it will be labeled with the corresponding reference numeral to aid in the understanding of the subject invention. Furthermore, reference should be had to all of the figures necessary to aid in the understanding of the specification even where a particular figure is referred to, as all reference numerals are not displayed in all figures in order to minimize confusion and aid in clarifying the subject invention. When the same item or feature does appear in a figure representing or disclosing an alternative embodiment of that part or feature, it is again labeled with the same reference numeral, followed by a numeric suffix to correspond with the designation of that alternative embodiment in the specification. The numeric designation of the alternative embodiment does not correspond to its preference but rather is intended to aid in the understanding of the subject invention.

As shown in FIGS. 4 and 8, a baffle 233-1 may be provided to control the lubricant within the sump 222-1 to minimize undesirable foaming or splashing due to the movement of the pickup tubes 220-1 therein. The baffle 233-1 also serves as means for reducing the rotational velocity of the lubricant induced by the centrifugal flow field. This in turn increases the relative velocity of the pickup tube inlet 232-1 with respect to the lubricant and therefore increases the rate of lubricant flow into the pickup tube inlet 232-1. Preferably the baffle 233 is in the form of an annular disk, extending about the lower bearing housing 112, and is spaced from the lower hermetic shell 26 to form a quiescent pool of lubricant swept by the pickup tube 220-1. Means for supporting the baffle at the selected spacing include formed or welded tabs extending from the baffle or supports extending from the lower hermtic shell 26. It is believed that other such means will be obvious to those skilled in the art.

Turning now to FIG. 5, the second alternative embodiment of the subject invention is disclosed. In FIG. 5, the first scroll member end plate 82-2 defines a radially extending lubricant passage 200-2. The lubricant passage 200-2 is provided with a lubricant passage outlet 202-2 for flow communication from the lubricant passage 200-2 to the first chamber 204-2 defined by the scroll wraps 80-2 and 100-2. This first chamber 204-2 is defined by the action of the outer tip portions 206-2 and 208-2 of the first and second scroll wraps 80-2 and 100-2, respectively. As the first scroll member 76-2 and the second scroll member 78-2 rotate on parallel but non-aligned axis, the first chamber alternatively opens and closes. acting as a suction inlet when the scroll apparatus 20-2 is functioning as a compression device. An annular seal 210-2 is provided in a groove 212-2 in the face of the central frame 30-2. Preferably, the seal 210-2 is forced into contact with the first scroll end plate 82-2 by an annular spring 214-2. The annular spring 214-2 cooperates with the annular seal 210-2 to prevent flow of lubricant radially outward from the collection chamber defined by the annular seal 210-2, the first scroll end plate 82-2, and the central portion 32-2. Lubricant thus collected in this collection chamber 217-2 flows to a first scroll lubricant passage inlet 216-2 and thence into the lubricant passage 200-2 which provides flow communication from the first scroll inlet 216-2 to the lubricant passage outlet 202-2.

In operation, therefore, during the rotation of the scroll members 76-2 and 78-2, lubricant flows into the oil passage 182-2 to lubricate the upper main bearing 38-2. Typically this lubricant is at discharge pressure, although it may be throttled to a lower pressure. After having lubricated the upper main bearing 38-2, the lubricant is typically discharged at or slightly above the suction pressure and is collected in the upper collection chamber 217-2 as noted above. The lubricant then flows into the first scroll lubricant passage inlet 216-2, through the first scroll lubricant passage 200-2, exiting into the first chamber 204-2 through the first scroll lubricant passage outlet 202-2.

Figure 6:
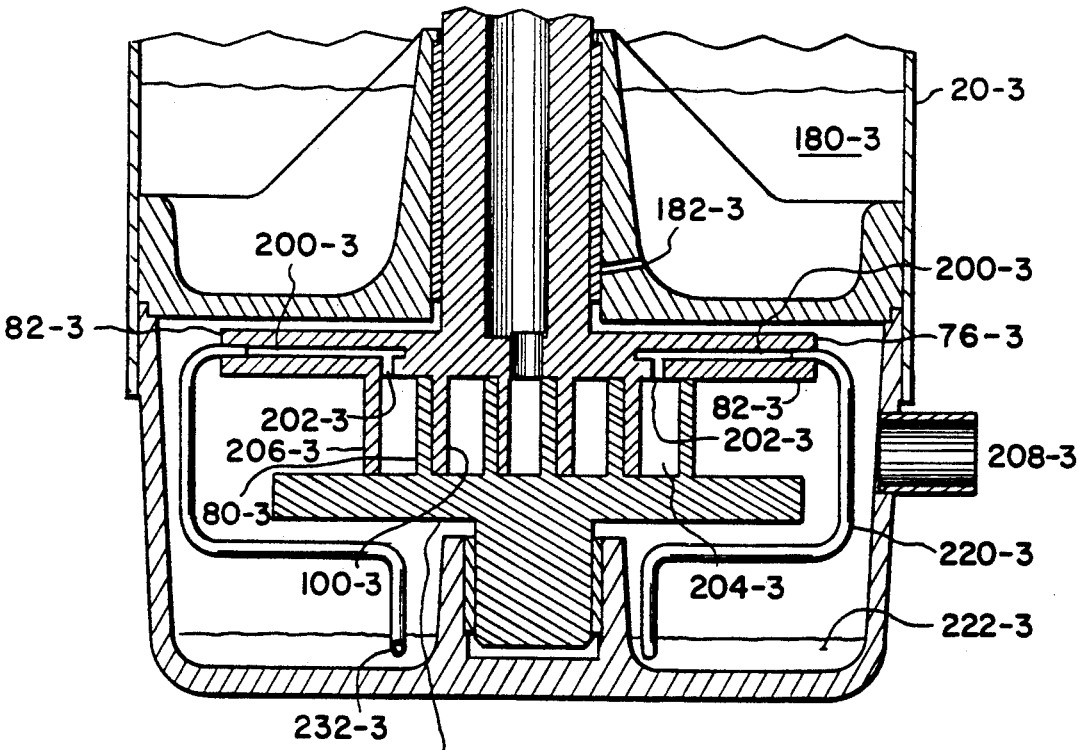
FIG. 6 shows an enlarged partial cross-sectional view of a third alternative embodiment of the subject invention.

Turning now to FIG. 6, a third alternative embodiment of the subject invention is shown. In this alternative embodiment, a lubricant passage 200-3 is drilled from the outer peripheral end of the scroll end plate 82-3 in the first scroll member 76-3 radially inward to join a first scroll lubricant passage outlet 202-3. A lubricant pickup tube 220-3 is provided. The pickup tube 220-3 extends from the first scroll end plate 82-3 into a sump 222-3 defined by the lower portion 26-3 of the hermetic shell 22-3. In this sump 222-3 collects the lubricant from the bearings of the scroll apparatus 20 as well as that which is precipitated from the incoming suction pressure fluids by the centrifugal action resulting from the centrifugal flow field generated in the incoming suction pressure fluids by the rotation of the scroll members 76-3 and 78-3 during operation of the scroll apparatus 20-3. The pickup tube 220-3 includes at its lowest end an aperture 232-3 which is oriented so that lubricant collected in the sump 222-3 is forced into the aperture 232-3 during rotation of the pickup tube 220-3. The pickup tube 220-3 is formed with the requisite bends to place the lubricant intake aperture 232-3 substantially within the radius of the lubricant passage outlet 202-3, as defined by the axis upon which the first scroll members 76-3 rotates. This permits the lubricant pickup tube 220-3 to effect a centrifugal pumping action which forces the lubricant into the tube 220-3, through the lubricant passage 200-3 and the lubricant outlet 202-3 into the first chamber 204-3.

Figure 6A:
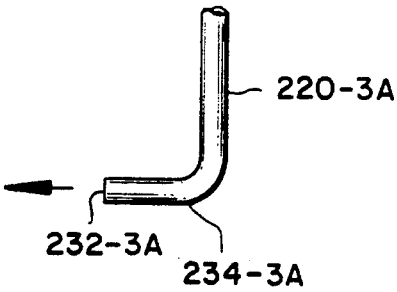
FIG. 6A shows a preferred embodiment of the lubricant pickup tube.
Figure 6B:
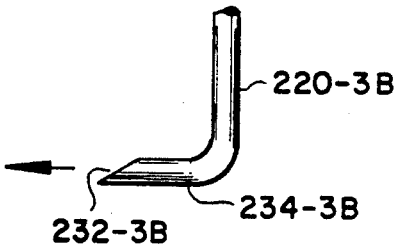
FIG. 6B shows an alternative embodiment of the lubricant pickup tube.
Figure 6C:
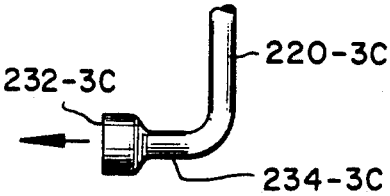
FIG. 6C shows yet another alternative embodiment of the lubricant pickup tube.

The lubricant intake aperture end portion 234-3 in which the lubricant intake aperture 232-3 is disposed is shown more clearly in FIGS. 6A, 6B and 6C. In these figures, the direction of travel is indicated by the arrow adjacent the inlet aperture 232-3. In FIG. 6A, the lubricant intake portion 234-3A is provided with a perpendicular end in which an aperture 232-3A is disposed. In FIG. 6B, the lubricant intake aperture portion 234-3B is provided with an angled tip in which the lubricant intake aperture 232-3B is disposed. In FIG. 6C, the lubricant intake aperture portion is enlarged relative to the intake portion 234-3C so that a relatively larger area is swept by the pickup tube 220-3C and thereby ensure an adequate flow of lubricant. In each embodiment, the lubricant intake aperture 232-3 is directed into the lubricant so that lubricant is forced into the lubricant pickup tube 220-3A, 220-3B or 220-3C respectively. Those skilled in the relevant art will recognize that the foregoing is exemplary in nature only, and that there would be many equally suitable alternative embodiments of the pickup tube 220.

The pressure head on the lubricant which is developed by the relative velocity of the pickup tube 220-3 to the lubricant and any centrifugal pumping action due to the relative positioning of the outlet 202-3 and the inlet tip portion 234-3 will vary considerably according to the scroll apparatus in which it is employed.

In operation of the alternative embodiment of FIG. 6, during rotation of the scroll apparatus 20, the pickup tubes 220-3 are rotated about the axis of the first scroll member 76-3 in the sump 222-3, forcing fluid into the lubricant inlet 232-3 by virtue of the pressure differential generated by the relative velocity of the pickup tube to the lubricant in the sump 222-3, through the pickup tube 220-3, the lubricant passage 200-3, the lubricant outlet 202-3 and into the first chamber 204-3.

Figure 7:
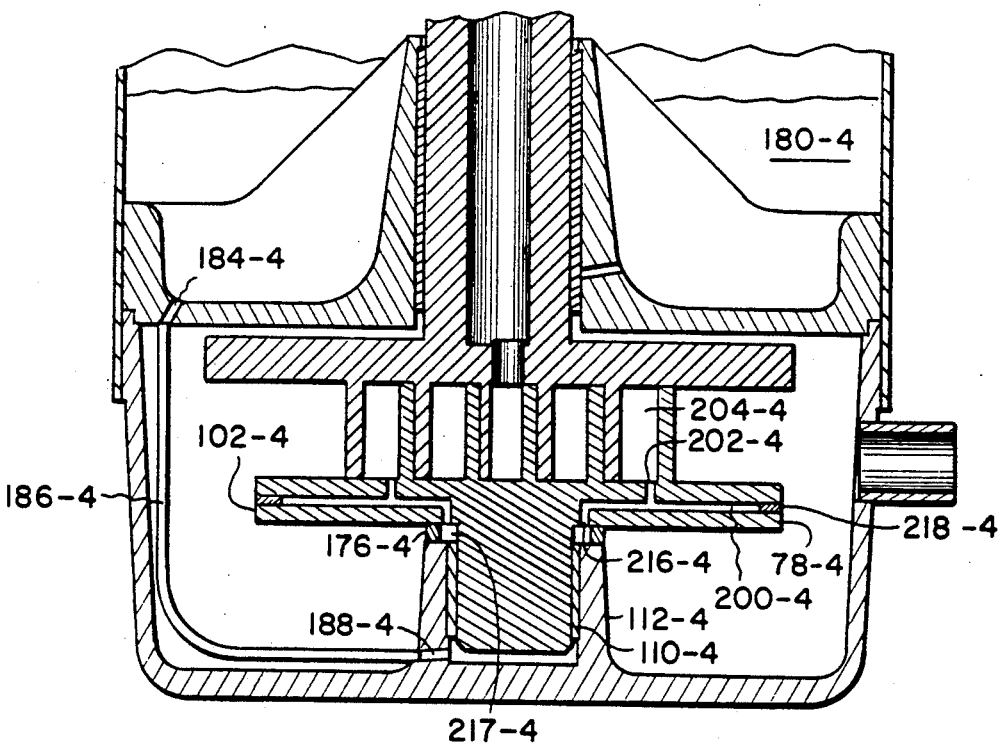
FIG. 7 shows an enlarged partial cross-sectional view of a fourth alternative embodiment of the subject invention.

A fourth alternative preferred embodiment of the subject invention is disclosed in FIG. 7. In FIG. 7, a second scroll member lubricant passage 200-4 is provided in the end plate 102-4 of the second scroll member 78-4. A second lubricant passage outlet 202-4 is provided for flow communication from the lubricant passage 200-4 to the first compression chamber 204-4. As with the alternative embodiment disclosed in FIG. 5, the lubricant passage 200-4 is drilled and sealed at the outer end thereof by a plug 218-4. A lubricant passage inlet 216-4 is provided at the inner radial end of the lubricant passage 200-4 for accepting oil from a collection chamber 217-4 defined by the thrust bearing 176-4, the lower bearing housing 112-4 and the second scroll member 78-4. In operation, lubricant is provided to the lower bearing 110-4 from the reservoir 180-4 through the assembly comprised of the lubricant passage 184-4, the lubricant supply tube 186-4 and the passage 188-4. After lubricating the lower bearing 110-4, the lubricant flows into the above described collection chamber 217-4 and then into the lubricant passage 200-4 by way of the lubricant passage inlet 216-4, whereupon it flows into the first chamber 204-4 via the lubricant passage outlet 202-4.

Another, fifth alternative embodiment of the subject invention is disclosed in FIG. 8. In this alternative embodiment, the lubricant passage 200-5 is provided through the end plate 102-5 of the second scroll member 78-5. A lubricant pickup tube 220-5 is provided for flow communication from the sump 222-5 in the lower shell portion 26-5 to the first chamber 204-5 through the lubricant passage 200-5. As with the lubricant pickup tubes described in FIG. 6, an inlet aperture 232-5 is provided for causing a pressure head and centrifugal pumping action of the lubricant collected in the sump 222-5. Therefore, in operation, the pickup tube 220-5 is rotated with the second scroll member 78-5, causing fluid to be accepted through the inlet aperture 232.5 and forced through the lubricant pickup tube 220-5 and the lubricant passage 200-5 into the first chamber 204-5.

Those skilled in the art will recognize that various combinations of the embodiments shown in FIGS. 5 through 8 are readily possible, and that these alternative embodiments may be combined with various drive means for operating the scroll member 76 and 78.

An example of one possible combination is disclosed in FIG. 9 as a sixth alternative embodiment. In this example of the scroll apparatus 20, the first scroll member 76 is provided with a lubricant passage 200 which is in flow communication with the first chamber 204 through a lubricant outlet 202 of the lubricant passage 200. The lubricant passage is provided with a first inlet which is comprised of a lubricant pickup tube 220 which extends into the compression plate 150. A compression plate lubricant passage is provided for flow communication from the lubricant pickup tube to a lubricant transfer tube 280. The lubricant pickup tube 220, the compression plate transfer passage 270 and the lubricant transfer tube 280 are taken together to comprise a first scroll lubricant passage first inlet. The scroll apparatus 20 in this exemplary embodiment is also provided with the annular seal 210 operating in the annular groove 212 and secured therein by the spring 214 to comprise the collection chamber for directing oil into a lubricant passage second inlet 216. In operation, this alternative embodiment of the scroll apparatus 20 provides lubricant to the first chamber 204 from both the sump 222 through the pickup tube 220 and from the collection chamber through lubricant passage second inlet 216.

Figure 12:
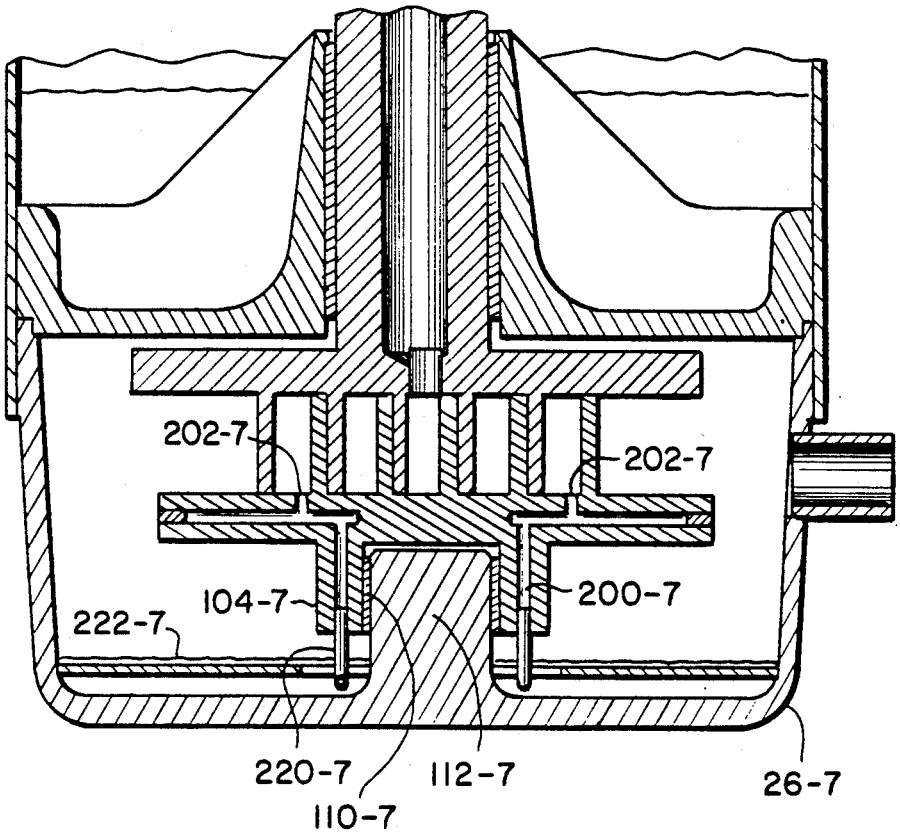
FIG. 12 shows an enlarged partial cross-sectional view of a seventh alternative embodiment of the scroll apparatus.

Yet another alternative embodiment is disclosed in FIG. 12, In this embodiment, the means for rotationally supporting the second scroll member 78 are interchanged. The lower bearing housing 112 and the second scroll member shaft 104 are functionally reversed in that the lower bearing housing is smaller in diameter than the second scroll member shaft 104, which is cylindrical. As with the preferred embodiment, a bearing 110 is provided to journal the rotation of the second scroll member shaft 104. No detailed description is believed necessary of the particulars of such a design, as they are believed generally known to those skilled in the art. However, the second scroll member shaft 104 is provided with lubricant passages 200 for flow connection with pickup tubes 220 extending from the end of the shaft 104 adjacent the hermetic shell portion 26. This embodiment is operationally equivalent to that described in FIG. 8, but provides for a more compact embodiment useful in smaller capacity scroll apparatus.

Returning again to FIGS. 1 and 3 for reference, the operation of the exemplary scroll apparatus 20 can be described. In operation, the motor 40 of the compressor assembly 20 is connected to an appropriate electrical supply (not shown) and actuated to cause rotation of the rotor 44. The rotor 44 in turn rotates the drive shaft 84, driving the driven end plate 82. The extension members 120 and the compression member 150 cause rotation of the biasing element spring 170 and thereby the lower or second scroll element 78. Because the axis of the first scroll member 76 and the second scroll member 78 are not aligned, a relative orbital motion is set up between the driven scroll wrap 80 and the idler scroll wrap 100, causing a plurality of chambers to be formed, with the first chamber as defined by the outer scroll portions 206 and 208 to form a first chamber which is alternatively open to the suction space and closed therefrom to be formed. The chambers thus formed are of decreasing volume toward the radially inward ends of the respective scroll wraps 80 and 100, such that fluid drawn into the first chamber is compressed as it is moved toward the radially inward ends of the respective scroll wraps 80 and 100.

The compressed fluid is then discharged from the scroll wraps 80 and 100 through the discharge aperture 88 into the discharge gallery 86 and thereafter into the discharge pressure portion of the hermetic shell 22 defined in the upper shell portion 24. Lubrication of the bearings 38 and 110, as well as the other components of the compressor assembly 20, is accomplished by the action of pressure upon the fluid contained in the reservoir 180. Lubricant is forced through the bearing lubrication aperture 182 to lubricant the upper main bearing 38, and is discharged into the suction pressure space thereafter. Lubrication of the lower main bearing 110 occurs through the passage 184, the lubricant supplied to 186 and the passage 188, with lubricant entering the collection chamber 217 as described above thereafter. This lubricant then flows into the second scroll lubricant passage 200 through the lubricant passage second inlet 216. Lubricant separated from inlet suction fluid flows into the sump 222 and accumulates therein with that discharged from the upper main bearing 38. Lubricant accumulating within the sump 222 is forced into the lubricant pickup tube inlet aperture 232 by the rotation of the second scroll element 78 and thereafter is pumped through the lubricant passage first inlet formed by the pickup tube 220 into the lubricant passage 200 and thereafter into the first chamber 204.

Those skilled in the art will appreciate the fact that the pickup tubes 220 will maintain the level of the sump 222 at a desired level, preventing an undesirable accumulation of fluid, whether the fluid is lubricant alone or condensed from the gases to be compressed or other unpumped fluid. The various lubricant passages 200 provide the desired effect of maintaining adequate lubrication of the scroll wraps 80 and 100 without undue consumption of power in the pumping of lubricant. The lubricant within the scroll wraps provides the additional benefit of improving the sealing of the compression chambers as well. Furthermore, the subject invention of lubricant passages is readily implemented in the scroll apparatus 20 without substantial modification thereto, while the provision of constant desirable lubrication prevents unnecessary wear in the scroll wraps and assures adequate lubrication of all moving components, reducing unnecessary wear and undue maintenance in the compressor assembly 20. It will be appreciated, therefore, that the compressor assembly 20 provides improved reliability and a longer operating life as compared to the previous scroll apparatus.

Modifications to the preferred and alternate embodiments of the subject invention will be apparent to those skilled in the art within the scope of the claims that follow hereinbelow.

What is claimed is:

1. A scroll compressor comprised of:

a first scroll member having a first scroll end plate and a first scroll wrap disposed on said first scroll end plate;

a second scroll member having a second scroll end plate and a second scroll wrap disposed thereon, said second scroll wrap cooperating with said first scroll wrap to form an alternately open and closed first chamber between the respective scroll wraps and said second scroll end plate defining a lubricant passage having an outlet in flow communication with said first chamber;

a lubricant pickup tube, affixed to said second scroll member and in flow communication with said lubricant passage, for delivering lubricant to said lubricant passage; and means for rotating said first and said second scroll members.

2. The scroll apparatus as set forth in claim 1 further comprising means for pressure biasing said second scroll member toward said first scroll member, said means for pressure biasing having a pressure responsive surface and defining an aperture, said pickup tube rotating within said aperture.

3. The scroll apparatus as set forth in claim 1 wherein said scroll apparatus further includes baffle means for increasing the relative velocity of lubricant with respect to said lubricant pickup tube.

4. The scroll apparatus as set forth in claim 1 wherein said compressor defines a sump and said means for delivering lubricant depends from said second scroll member into said sump, said scroll apparatus further comprising:

means for rotatably supporting said second scroll member; and means for lubricating said second scroll member rotation support means.

5. The scroll apparatus as set forth in claim 1 wherein said second scroll member includes:

means for rotatably supporting said second scroll member; and means for lubricating said second scroll member rotation support means.

6. A scroll apparatus comprised of:

a shell defining a suction pressure portion and a sump;

a first scroll member disposed in said suction pressure portion, said first scroll member having a first scroll end plate, a first scroll shaft and a first scroll wrap, said first scroll wrap disposed on said first scroll end plate;

a second scroll member disposed in said suction pressure portion, said second scroll member having a second scroll end plate, a second scroll shaft and a second scroll wrap, said second scroll wrap disposed on said second scroll end plate in interleaving engagement with said first scroll wrap, said second scroll wrap cooperating with said first scroll wrap to form an alternately open and closed first chamber, said second scroll end plate further defining a first lubricant passage in flow communication with said first chamber;

a lubricant pickup tube affixed to said second scroll member for picking up lubricant from said sump and delivering it to said first lubricant passage;

bearing means for rotatably supporting said first scroll member and said second scroll member; and means for concurrently rotating said first and second scroll members.

7. The scroll apparatus as set forth in claim 6 wherein said lubricant pickup tube has an inlet orifice disposed in said sump.

8. The scroll apparatus as set forth in claim 7 wherein said scroll apparatus further includes baffle means for increasing the relative velocity of lubricant with respect to said lubricant pickup tube.

9. The scroll apparatus as set forth in claim 7 wherein said lubricant pickup tube is L shaped.

10. The scroll apparatus as set forth in claim 6 wherein said means for picking up lubricant from said sump and delivering to said first lubricant passage depends from said second scroll member into said sump and defines a flow path from said sump to said first lubricant passage, said scroll apparatus further comprising means for lubricating said second scroll member bearing means.

11. The scroll apparatus as set forth in claim 10 wherein said scroll apparatus defines a lubricant collection chamber adjacent said second scroll shaft, said second scroll member further defining a second lubricant passage from said lubricant collection chamber to said first lubricant passage.

12. Scroll apparatus comprising:

a shell defining a suction pressure portion and a sump;

a first scroll member disposed in said suction pressure portion, said first scroll member having a first scroll end plate, a first scroll shaft, and a first scroll wrap, said first scroll wrap being disposed on said first scroll end plate, said first scroll member defining a lubricant passage having an outlet;

a second scroll member disposed in said suction pressure portion, said second scroll member having a second scroll end plate, a second scroll shaft and a second scroll wrap disposed on said second scroll end plate in interleaving engagement with said first scroll wrap, said second scroll wrap cooperating with said first scroll wrap to form an alternately open and closed first chamber, said first chamber being in flow communication with said outlet of said lubricant passage in said first scroll member;

a lubricant pickup tube extending into said sump, said pickup tube being in flow communication with said lubricant passage defined by said first scroll member;

bearing means for rotatably supporting said first scroll member and said second scroll member; and means for concurrently rotating said first and second scroll members.

13. The scroll apparatus as set forth in claim 12 wherein said first scroll member defines an inlet to said first scroll lubricant passage, said lubricant pick tube being affixed to said first scroll member and in flow communication with said inlet to said first scroll lubricant passage.

14. The scroll apparatus as set forth in claim 12 wherein said scroll apparatus further includes:

means for lubricating said first scroll member bearing means; and means for delivering said lubricant to said first scroll lubricant passage.

15. The scroll apparatus as set forth in claim 14 wherein said means for delivering lubricant to said first scroll lubricant passage is further comprised of a lubricant passage inlet defined in said first scroll member and a lubricant collection chamber adjacent said first scroll shaft.

16. A scroll compressor apparatus comprised of:

a hermetic shell defining a suction pressure portion and a discharge pressure portion, said hermetic shell defining a sump in said suction pressure portion;

a first scroll member disposed in said suction pressure portion, said first scroll member having a first scroll end plate, a first scroll shaft and an oppositely directed first scroll wrap disposed on said first scroll and plate, said first scroll member defining a lubricant passage having an outlet defined in said first scroll end plate, said first scroll member including a lubricant pickup tube cooperating with said lubricant passage to define a flow path between said sump and said outlet;

a second scroll member disposed in said suction pressure portion, said second scroll member having a second scroll end plate, a second scroll shaft and an oppositely directed second scroll wrap disposed on said second scroll end plate in interleaving engagement with said first scroll wrap, said second scroll wrap cooperating with said first scroll wrap to form an alternately open and closed compression chamber, said compression chamber being in flow communication with said outlet defined in said first scroll member;

bearing means for rotatably supporting said first scroll member;

bearing means for rotatably supporting said second scroll member;

means for lubricating said first and said second scroll member bearing means;

a motor driveably connected to said first scroll member shaft for rotating said first scroll member; and means for concurrently rotating said second scroll member with said first scroll member.

17. The scroll compressor as set forth in claim 16 wherein said first scroll member further defining a first scroll lubricant passage second inlet adjacent said first scroll shaft.

18. The scroll compressor as set forth in claim 17 wherein said hermetic shell further includes a central shell portion for separating said suction pressure portion and said discharge pressure portion.

19. The scroll compressor as set forth in claim 18 wherein said scroll compressor further includes means for lubricating said first scroll bearing means.

20. The scroll compressor as set forth in claim 19 wherein said scroll compressor further includes an annular seal disposed between said central shell portion and said first scroll end plate for defining a collection chamber for collecting said lubricant from said lubricating means for said first scroll bearing means.

21. The scroll compressor as set forth in claim 16 wherein said first scroll member includes a compression plate.

22. The scroll compressor as set forth in claim 21 wherein said first scroll member lubricant pickup tube is secured to said compression plate.

23. The scroll compressor as set forth in claim 22 wherein said compression plate further defines a lubricant transfer passage therethrough in flow communication with said first scroll lubricant pickup tube.

24. The scroll compressor as set forth in claim 23 wherein said first scroll member further includes a lubricant transfer tube extending between said first scroll end plate and said first scroll compression plate for flow communication between said lubricant transfer passage and said first scroll lubricant passage.

25. The scroll compressor as set forth in claim 24 wherein said suction pressure portion of said hermetic shell further includes baffle means for increasing the relative velocity of lubricant with respect to said lubricant pickup tube.

26. A refrigeration system for circulating refrigerant in closed loop connection comprised of:

a condenser for condensing refrigerant to liquid form;

an expansion device for receiving liquid refrigerant from said condenser and expanding the refrigerant;

an evaporator for receiving the refrigerant from said expansion device and evaporating the refrigerant to vapor form;

a compressor for receiving the refrigerant from the evaporator, compressing the refrigerant and delivering the refrigerant to the condenser, said compressor including;

(i) a hermetic shell defining a suction pressure portion and a discharge pressure portion, said hermetic shell defining a sump in said suction pressure portion;

(ii) a first scroll member disposed in said suction pressure portion, said first scroll member having a first scroll end plate, a first scroll shaft and an oppositely directed first scroll wrap disposed on said first scroll end plate, said first scroll member defining a lubricant passage and including a lubricant pickup tube in flow communication with said lubricant passage and said sump;

(iii) a second scroll member disposed in said suction pressure portion, said second scroll member having a second scroll end plate, a second scroll shaft and an oppositely directed second scroll wrap disposed thereon in interleaving engagement with said first scroll wrap, said second scroll wrap cooperating with said first scroll wrap to form an alternately open and closed compression chamber in flow communication with said lubricant passage defined in said first scroll member;

(iv) bearing means for rotatably supporting said first scroll member;

(v) bearing means for rotatably supporting said second scroll member;

(vi) means for lubricating said second scroll member bearing means; and (vii) a motor driveably connected to said first scroll member shaft.

27. The scroll compressor as set forth in claim 26 wherein said hermetic shell further includes a central shell portion for separating said suction pressure portion and said discharge pressure portion.

28. The scroll compressor as set forth in claim 27 wherein said scroll compressor further includes means for lubricating said first scroll bearing means.

29. The scroll compressor as set forth in claim 26 wherein said first scroll member includes a compression plate.

30. The scroll compressor as set forth in claim 29 wherein said first scroll member lubricant pickup tube is secured to said compression plate.

31. The scroll compressor as set forth in claim 30 wherein said compression plate further defines a lubricant transfer passage therethrough in flow communication with said first scroll lubricant pickup tube.

32. The scroll compressor as set forth in claim 31 wherein said first scroll member further includes a lubricant transfer tube extending between said first scroll end plate and said first scroll compression plate for flow communication between said lubricant transfer passage and said first scroll lubricant passage.

* * * * *